US006427094B1

(12) United States Patent
Mizuno

(10) Patent No.: US 6,427,094 B1
(45) Date of Patent: Jul. 30, 2002

(54) AXIAL ALIGNMENT APPARATUS, AN EYEGLASS LENS PROCESSING SYSTEM AND AN EYEGLASS LENS PROCESSING PREPARATION SYSTEM HAVING THE APPARATUS

(75) Inventor: Toshiaki Mizuno, Aichi (JP)

(73) Assignee: Nidek Co., Ltd., Aichi (JP)

( * ) Notice: Subject to any disclaimer, the term of this patent is extended or adjusted under 35 U.S.C. 154(b) by 0 days.

(21) Appl. No.: 09/280,856

(22) Filed: Mar. 30, 1999

(30) Foreign Application Priority Data

Mar. 31, 1998 (JP) ..... 10-125447

(51) Int. Cl.[7] ..... G06F 19/00
(52) U.S. Cl. ..... 700/159; 451/42
(58) Field of Search ..... 700/157, 159; 451/42, 43, 5, 6, 240

(56) References Cited

U.S. PATENT DOCUMENTS

| | | | | | |
|---|---|---|---|---|---|
| 4,096,684 | A | * | 6/1978 | Akaba et al. | 451/240 |
| 4,217,736 | A | * | 8/1980 | Akaba et al. | 451/43 |
| 4,737,918 | A | | 4/1988 | Langlois et al. | 700/164 |
| 4,798,459 | A | | 1/1989 | Joncour | 356/127 |
| 5,155,940 | A | | 10/1992 | Suzuki | 451/5 |
| 5,428,448 | A | * | 6/1995 | Albert-Garcia | 356/612 |
| 5,716,256 | A | | 2/1998 | Mizuno et al. | 451/5 |
| RE35,898 | E | | 9/1998 | Shibata et al. | 211/85.3 |
| 5,890,949 | A | * | 4/1999 | Shibata | 451/5 |
| 6,159,072 | A | * | 12/2000 | Shibata | 451/6 |

FOREIGN PATENT DOCUMENTS

| | | |
|---|---|---|
| EP | 0363281 | 4/1990 |
| EP | 0753781 | 1/1997 |
| JP | 3-113415 | 5/1991 |

* cited by examiner

*Primary Examiner*—Leo Picard
*Assistant Examiner*—Chad Rapp
(74) *Attorney, Agent, or Firm*—Sughrue Mion, PLLC

(57) ABSTRACT

An axial alignment apparatus for performing axial alignment for attaching a cup as a processing jig to a subject lens, includes: an imaging device for picking up an image of the lens; an input device for inputting a picture signal picked up by the imaging device into one of an eyeglass lens processing apparatus and an eyeglass frame configuration measuring apparatus, the apparatus having a box separated from the axial alignment apparatus and a display for indicating the configuration of an eyeglass frame; and an attaching device for attaching the cup to the lens. The axial alignment for attaching the cup to the lens by the attaching device is performed while observing the image of the lens indicated on the display on the basis of the picture signal inputted by the input device.

7 Claims, 5 Drawing Sheets

CCD CAMERA
1
9
9a
20
FRAME-CONFIGURATION MEASURING SECTION
24
LENS-CONFIGURATION MEASURING SECTION
21
PROCESSING SECTION
30
41
40
CONTROL UNIT
23
23m
22
50
52
51
FPO : 69.0
PD : 62.0
U/D : 20
SIZE : 0.00
OPTICAL CENTER
PLA METAL AUTO R
60
61
62
23e
FRAME CHANGE
23i
CHANGE
NEXT DATA
START /STOP
23d
R/L
+
TRACING
DOUBLE GRINDING
23c
MODE
−
23h
23b
FRAME
△
▽
23g
23k
LENS CHUCK
23a
LENS
SCREEN CHANGE
23f

AXIAL ALIGNMENT APPARATUS, AN EYEGLASS LENS PROCESSING SYSTEM AND AN EYEGLASS LENS PROCESSING PREPARATION SYSTEM HAVING THE APPARATUS

BACKGROUND OF THE INVENTION

1. Field of the Invention

The present invention relates to an axial alignment apparatus (a cup attaching apparatus) adapted for performing an axial alignment for attaching a cup, as a processing jig, to a subject lens to be processed by an eyeglass lens processing apparatus. Further, the invention relates to an eyeglass lens processing system and an eyeglass lens processing preparation system having the axial alignment apparatus.

2. Description of the Related Art

An lens processing apparatus is known, which has a display unit for graphically indicating an intended lens configuration (the target lens configuration) on the basis of input data indicative of the configuration of a frame to which a subject lens is set and a layout unit for obtaining layout information indicative of a layout of the subject lens with respect to the intended lens shape. The apparatus carries out a bevel calculation to determine a bevel to be formed on a peripheral edge of the lens on the basis of the inputted frame data and layout information. The configuration of the bevel to be formed as a consequence of processing is indicated on the display unit. Further, the state of the bevel can be simulated and confirmed on the display before processing by changing the position of the bevel to be formed on the edge or designating an arbitrary position on the edge.

As the work prior to processing the subject lens by the aforementioned processing apparatus, a cup as a processing jig is attached on the subject lens by an axial alignment apparatus. As the axial alignment apparatus, there is known an optical-type axial alignment apparatus in which an image of the subject lens illuminated from below by illumination light is projected onto a screen, and the axial alignment is performed while a marked point on the lens projected onto the screen and a reference scale are observed.

There is also known another axial alignment apparatus in which a display unit for indicating the intended lens configuration and a layout unit for obtaining layout information are provided in the axial alignment apparatus per se.

The related axial alignment apparatuses, however, has the following disadvantages. Although the former axial alignment apparatus has an advantage in the cost of the apparatus because of the simple configuration, confirmation as to whether the size of the subject lens is sufficient to the eyeglass frame is made only on the processing apparatus side after the cup is attached to the subject lens. When the lens size is insufficient, a lens having a larger size must be prepared and the attaching of the cup must be retried. This makes the workability poor.

On the other hand, the latter axial alignment apparatus can make a judgment before the attaching of the cup as to whether the processing can be applied to the subject lens or not, by comparing the size of the subject lens with the intended lens configuration indicated on the display unit after the axial alignment. However, to give the display unit and layout unit to the axial alignment apparatus per se makes the configuration of the axial alignment apparatus complex and large in size. Further, in case that a system is configured with the aforementioned processing apparatus, functions of the display unit and the like are overlapped, so that the total cost becomes rather high.

SUMMARY OF THE INVENTION

In view of the problem of the aforementioned related art, a technical object of the present invention is to provide an axial alignment apparatus in which a judgment, before attaching a cup, as to whether processing can be applied or not can be made by a simple configuration.

To solve the aforementioned problem, the present invention is characterized by the following configurations.

(1) An axial alignment apparatus for performing axial alignment for attaching a cup as a processing jig to a subject lens, includes:

an imaging device for picking up an image of the lens;

an input device for inputting a picture signal picked up by the imaging device into one of an eyeglass lens processing apparatus and an eyeglass frame configuration measuring apparatus, the apparatus having a box separated from the axial alignment apparatus and a display for indicating the configuration of an eyeglass frame; and an attaching device for attaching the cup to the lens, wherein the axial alignment for attaching the cup to the lens by the attaching device is performed while observing the image of the lens indicated on the display on the basis of the picture signal inputted by the input device.

(2) The axial alignment apparatus according to (1), further including:

an illumination device for illuminating the lens; and a screen for projecting thereon an image of the lens illuminated by the illumination device;

wherein the imaging device picks up the image of the lens projected onto the screen.

(3) An eyeglass lens processing system including an eyeglass lens processing apparatus for grinding an eyeglass lens to be fitted to an eyeglass frame, and an axial alignment apparatus for performing axial alignment for attaching a cup as a processing jig to the lens, the eyeglass lens processing apparatus including:

a processing device for grinding the lens;

an input device for inputting the configuration of the eyeglass frame; and a display for indicating the configuration of the eyeglass frame inputted by the input device;

the axial alignment apparatus including:

an imaging device for picking up an image of the lens;

a transmission device for transmitting a picture signal picked up by the imaging device to the eyeglass lens processing apparatus; and an attaching device for attaching the cup to the lens;

wherein the axial alignment for attaching the cup to the lens by the attaching device is performed while observing the image of the lens indicated on the display on the basis of the picture signal transmitted by the transmission device.

(4) The eyeglass lens processing system according to (3), wherein the eyeglass lens processing apparatus further includes formation means for forming an axial-alignment mark on the display, the axial-alignment mark having a predetermined positional relation with a pick-up optical axis of the imaging device.

(5) The eyeglass lens processing system according to (4), wherein the eyeglass lens processing apparatus further includes layout device for inputting layout data for performing layout of the lens with regard to the configuration of the eyeglass frame indicated on the display, wherein the formation means forms the axial-alignment mark on the basis of the layout data inputted by the layout device.

(6) The eyeglass lens processing system according to (3), wherein the eyeglass lens processing apparatus further includes measurement device for measuring the configuration of the eyeglass frame, wherein the input device inputs the configuration of the eyeglass frame measured by the measurement device.

(7) The eyeglass lens processing system according to (3), wherein the eyeglass lens processing apparatus and the axial alignment apparatus are provided in separate boxes respectively.

(8) An eyeglass lens processing preparation system including an eyeglass frame configuration measuring apparatus for measuring the configuration of an eyeglass frame, and an axial alignment apparatus for performing axial alignment for attaching a cup as a processing jig to a lens, the eyeglass frame configuration measuring apparatus including:

a measurement device for measuring the configuration of the eyeglass frame; and a display for indicating the configuration of the eyeglass frame measured by the measurement device;

the axial alignment apparatus including:

an imaging device for picking up an image of the lens;

a transmission device for transmitting a picture signal picked up by the imaging device to the eyeglass frame configuration measuring apparatus; and an attaching device for attaching the cup to the lens, wherein the axial alignment for attaching the cup to the lens by the attaching device is performed while observing the image of the lens indicated on the display on the basis of the picture signal transmitted by the transmission device.

(9) The eyeglass lens processing preparation system according to (8), wherein the eyeglass frame configuration measuring apparatus further includes formation device for forming an axial-alignment mark on the display, the axial-alignment mark having a predetermined positional relation with a pick-up optical axis of the imaging device.

(10) The eyeglass lens processing preparation system according to (9), wherein the eyeglass frame configuration measuring apparatus further includes layout device for inputting layout data for performing layout of the lens with regard to the configuration of the eyeglass frame indicated on the display, wherein the formation device forms the axial-alignment mark on the basis of the layout data inputted by the layout device.

(11) The eyeglass lens processing preparation system according to (10), further comprising an input device for supplying frame data after the layout performed by the layout device to an eyeglass lens processing apparatus.

(12) The eyeglass lens processing preparation system according to (8), wherein the eyeglass frame configuration measuring apparatus and the axial alignment apparatus are provided in separate boxes respectively.

(13) The eyeglass lens processing preparation system according to (8), further comprising an input device for supplying the configuration of the eyeglass frame measured by the measurement device to an eyeglass lens processing apparatus.

DETAILED DESCRIPTION OF THE PREFERRED EMBODIMENT

Figure 1:
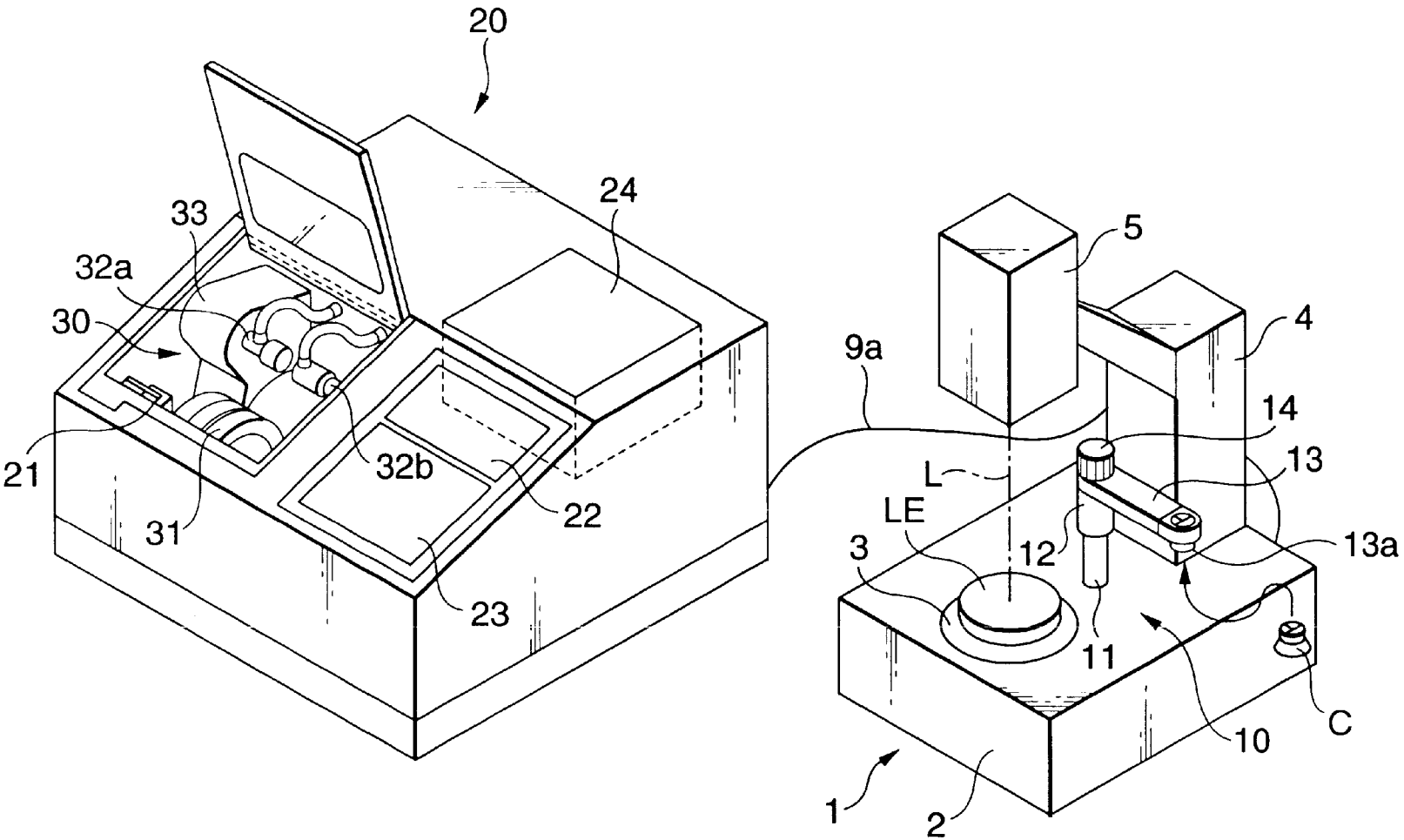
FIG. 1 is a view showing the external appearance of a system configuration structured by an eyeglass lens processing apparatus and an axial alignment apparatus according to the present invention.
Figure 2:
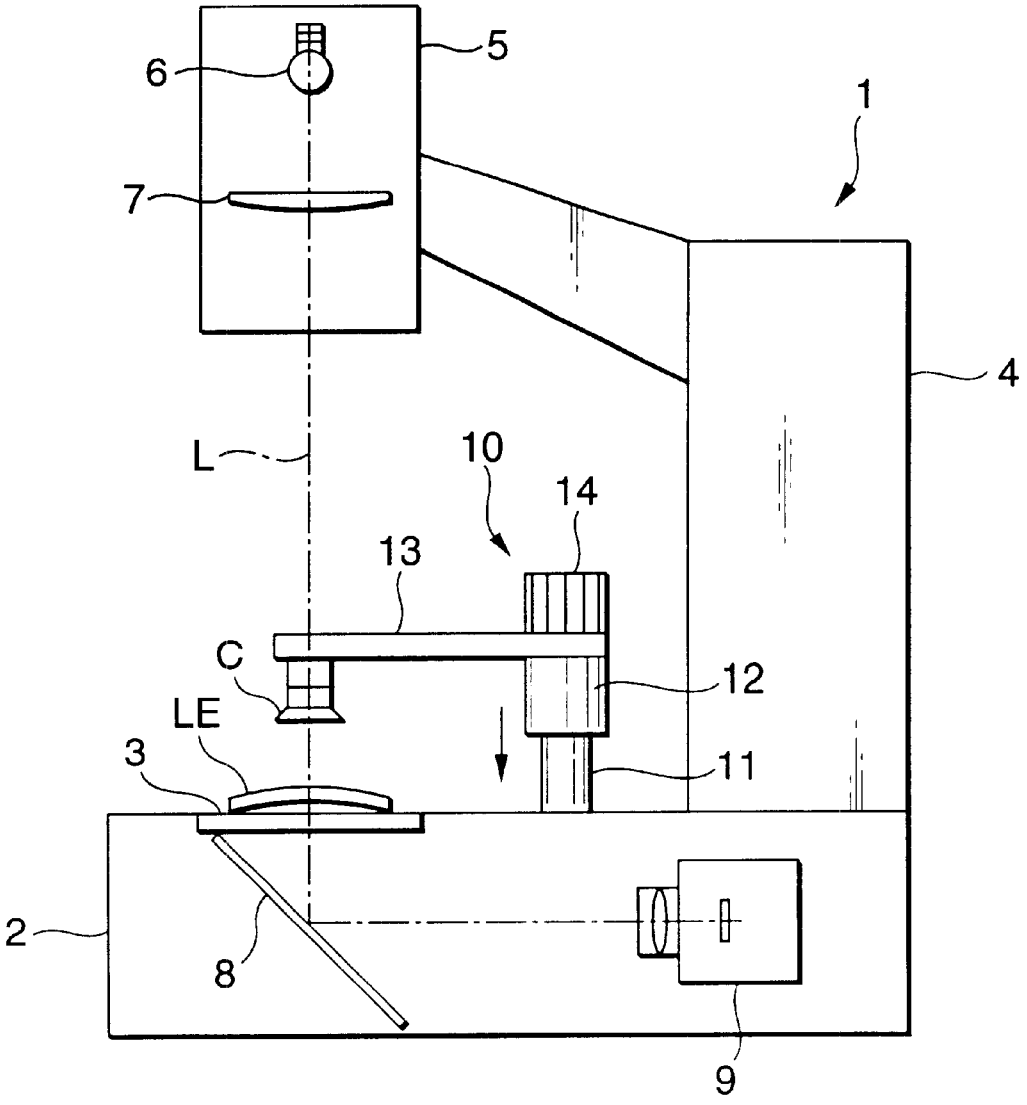
FIG. 2 is a side view of the axial alignment apparatus, showing its optical arrangement.

An embodiment of the present invention will be described below with reference to the drawings. FIG. 1 is a view showing the external appearance of a system constituted by an eyeglass lens processing apparatus and an axial alignment apparatus according to the present invention. FIG. 2 is a side view of the axial alignment apparatus, showing its optical arrangement.

The reference numeral 1 designates an axial alignment apparatus. The reference character L designates an axial-alignment reference axis. A screen plate 3 on which a subject lens LE is mounted is provided in an upper surface of a main body casing 2 with the reference axis L as a center. The screen plate 3 is made of a semitransparent material such as frosted glass, or the like. An illumination unit 5 supported by a support member 4 fixed to the casing 2 is disposed above the screen plate 3. On the reference axis L, the unit 5 has an illumination light source 6 and a condensing lens 7 for condensing the luminous flux. Further, a mirror 8 located below the screen plate 3 and a CCD camera 9 are disposed in the inside of the casing 2. An image of the lens LE is projected onto the screen plate 3 on the basis of the illumination light from the light source 6, so that the image is formed on an image pick-up surface of the CCD camera 9 through the mirror 8.

The reference numeral 10 designates a cup attaching section for attaching a cup C as a processing jig onto the lens LE. The attaching section 10 has a cylindrical shaft 12 that is rotatable and vertically movable along a support shaft 11 fixed to the casing 2. The shaft 12 is always urged upward by a spring (not shown) provided in the support shaft 11. An arm 13 and a rotary knob 14 are attached to the shaft 12. An attachment portion 13*a* for fitting a proximal portion of the cup C thereto is provided in a lower portion of a leading end of the arm 13. The arm 13 can rotate together with the shaft 12 from the state shown in FIG. 1 to a position where the center of the cup C coincides with the reference axis L. The rotation position of the arm 13 is regulated by a regulation member (not shown). In order to attach the cup C to the lens LE, the proximal portion of the cup C is inserted in the attachment portion 13*a* in conjunction with a positioning mark provided to an upper portion of the leading end of the arm 13 so that the cup C faces to a predetermined direction. Then, the knob 14 is turned so as to make the center of the cup C coincident with the reference axis L, and the upper portion of the knob 14 is pushed down to attach the cup C to the lens LE.

As described above, the axial alignment apparatus 1 has the same compact configuration as that of an optical type axial alignment apparatus.

The reference numeral 20 designates a lens processing apparatus for processing the lens LE; and 30, a processing section for grinding the lens LE. The processing section 30 has: a whetstone group 31 including a plurality of whetstones (a glass-purpose rough whetstone, a plastic-purpose rough whetstone, and a finishing whetstone) which rotate at a high speed; two lens rotation shafts 32*a* and 32*b* for chucking the lens LE having the cup C attached thereto; and a carriage 33 which is moveable in a direction of the axis of rotation while holding the rotation shafts 32*a* and 32*b* and which is turnable toward the whetstone group 31. A lens-configuration measuring section 21 is disposed in the neighborhood of the processing section 30. A display 22 for indicating processing information and an operation panel 23 having various operation switches are disposed in a front surface of a box of the processing apparatus 20. Further, an eyeglass frame-configuration measuring section 24 for measuring the configuration of an eyeglass frame is integrally provided in a rear portion of the apparatus. The main structure of the processing apparatus 20 is basically equivalent to that of the apparatus described in JP-A-5-212661 (U.S. Pat. No. 5,347,762) by the applicant of the present invention, etc, and the details of the main structure can be known by referring thereto.

Figure 3:
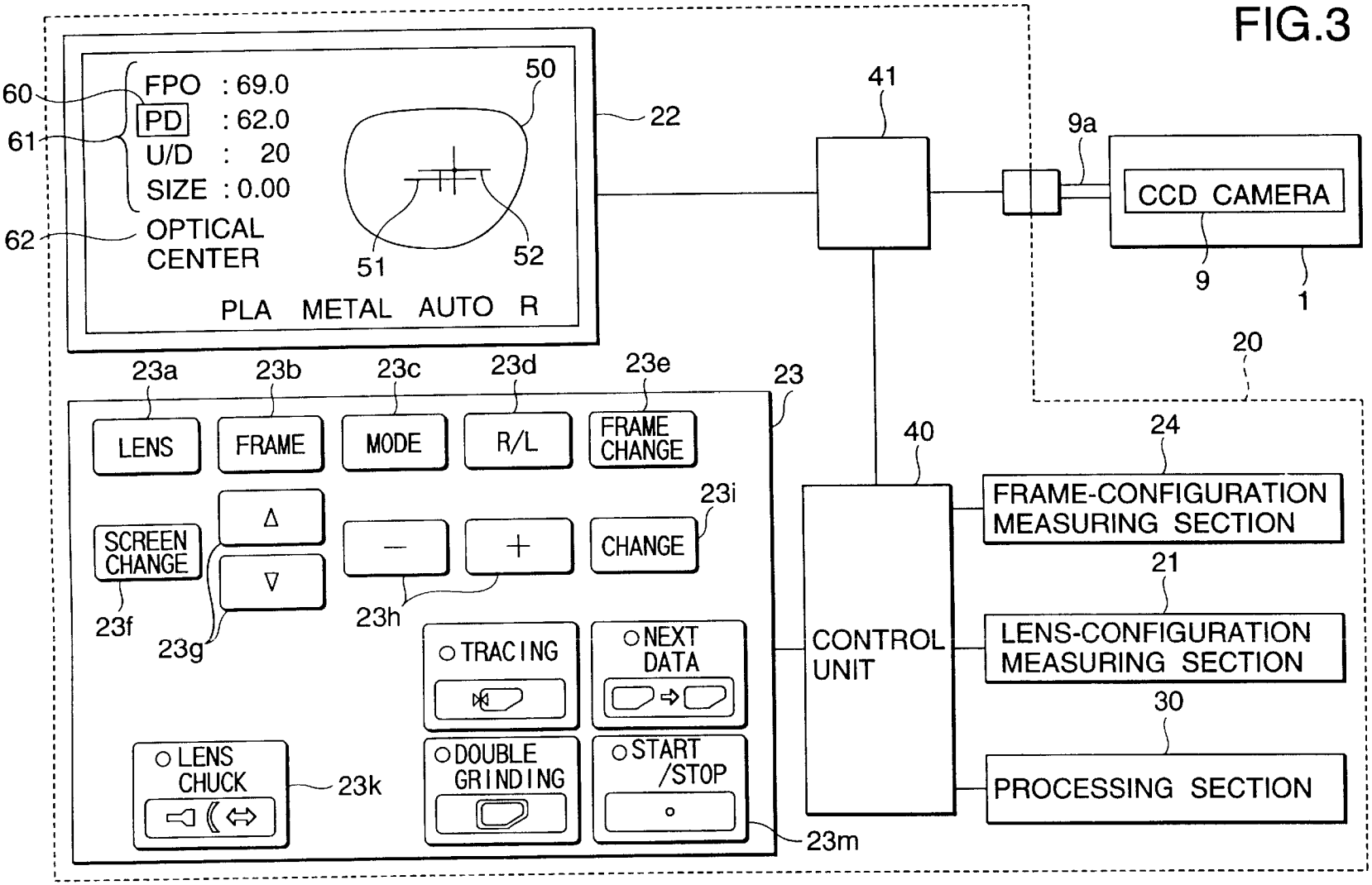
FIG. 3 is a block diagram of a controlling system in the system configuration according to the embodiment of the present invention.

FIG. 3 is a block diagram of a controlling system in this system configuration. A picture signal from the CCD camera 9 is inputted into an image synthesizing section 41 on the processing apparatus 20 side through a cable 9*a*. The image synthesizing section 41, which is connected to a control unit 40, synthesizes the picture signal with characters and graphics generated under the control of the control unit 40 to indicate the synthesized signal on the display 22. Further, the operation panel 23, the eyeglass frame-configuration measuring section 24, the lens-configuration measuring section 21 and the processing section 30 are connected to the control unit 40.

The operation the above-mentioned system configuration will be described below. First, the configuration of an eyeglass frame to which the lens LE is set is measured by the eyeglass frame-configuration measuring section 24 in advance. The data thus measured is inputted. The inputted frame data is stored in a memory provided in the control unit 40. At the same time, an intended lens configuration 50 based on the frame data and a mark 51 expressing the center of the configuration 50 are indicated on the display 22. An operator inputs the material of the lens to be processed, the material of the eyeglass frame and processing conditions such as a processing mode, etc., through switches 23*a* to 23*e* of the operation panel 23 in advance. Further, the layout data of the lens with regard to the frame configuration is inputted as follows.

Input items of the layout are indicated in the left of a screen on the display 22. A reverse-image cursor 60 is moved up and down by cursor moving switches 23*g* to select an input item.

With respect to input items 61 of FPD (the distance between the geometrical centers of the frame), PD (the distance between the pupils of a person to wear eyeglasses), U/D (the height of the optical center of the lens from the geometrical center of the frame) and size (correction of the finished size of the lens), values thereof are changed by increasing/decreasing through numerical value change switches 23*h* to thereby input layout data. Further, if necessary, the reverse-image cursor 60 is set to an input item 62 and a switch 23*i* is pushed to change the layout mode. The layout mode can be selected from the group of an optical center mode for aligning an axis to the optical center of the lens, a frame center mode for aligning an axis to the geometrical center of the eyeglass frame and a bifocal mode.

In the case of an optical center mode, a cross reticle mark 52 expressing the optical center placed on the reference point is indicated on the screen of the display 22. By inputting layout data, the intended lens configuration 50 and the center mark 51 are displayed while moving relative to the reticle mark 52. In the case of a frame center mode, the center mark 51 is placed on the reference point. By inputting layout data, the reticle mark 52 is displayed while moving.

Figure 4:
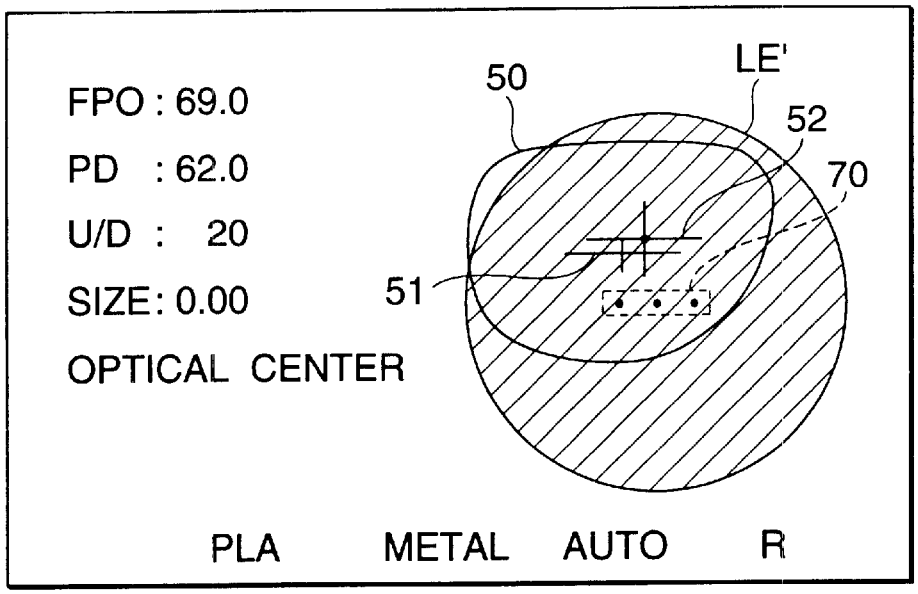
FIG. 4 is a view showing an example of the display screen on the display provided in the processing apparatus.

After the input of necessary layout data is completed, the axial alignment of the lens LE is preformed by the axial alignment apparatus 1. First, the optical center mode which the cup is attached to the optical center will be described as an example. A lens LE with a marked point marked by a lens meter is attached on the screen 3. The lens LE is illuminated by illumination light from the unit 5, so that an image of the lens LE is projected onto the screen 3. A picture signal of the lens image picked up by the CCD camera 9 is inputted to the processing apparatus 20 side. FIG. 4 shows an example of the display screen in this occasion. The lens image LE' of the lens LE is projected onto the screen of the display 22. The reference numeral 70 designates three marked point images which are marked on the lens LE. Incidentally, the position of the reference point expressed as the center of the reticle mark 52 on the display 22 in this occasion is set so as to coincide with the position of the pick-up optical axis of the CCD camera 9 (that is, the position of the reference axis L).

The operator moves the lens LE on the screen 3 while observing the display 22 so as to make the mark image of a marked point in the center of a marked point images 70 coincide with the center of the reticle mark 52. Further, the operator rotates the lens LE to adjust the axis angle so as to make left and right mark images in the marked point images 70 come on the horizontal line of the reticle mark 52. Thus, the axial alignment of the lens LE is completed. By observing both the size of the lens image LE' and the intended lens configuration 50 in this occasion, the operator can judge whether the lens size is sufficient or not, that is, whether the processing can be applied to the lens LE or not. If there is no problem in the size of the lens LE, attaching of the cup C is executed by the attaching section 10.

Figure 5:
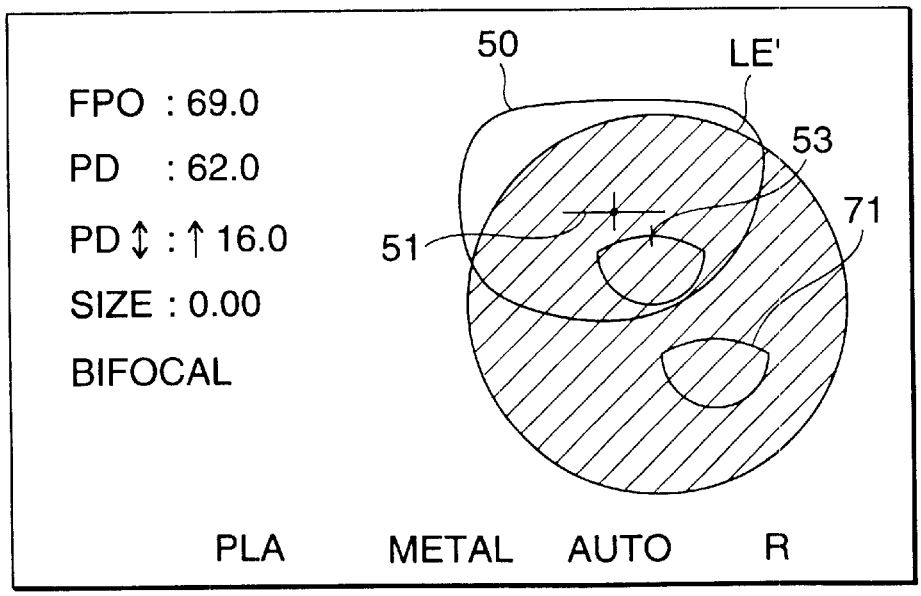
FIG. 5 is a view showing an example of the display screen in the case of a bifocal mode.

In the case of a frame center mode, the lens LE is moved to perform the axial alignment so that the marked point image 70 overlaps with the center mark 51 of the intended lens configuration 50. Further, in the case of a bifocal mode, as shown in FIG. 5, a small lens mark 53 is indicated on the display 22 in accordance with a bifocal layout. Accordingly, the axial alignment is performed so that a small lens image 71 picked up by the CCD camera 9 coincides with the small lens mark 53. Also in these frame center and bifocal modes, the judgment as to whether the processing can be applied to the lens LE or not, can be made before the attaching of the cup C, by observing both of the size of the lens image LE' and the intended lens configuration 50.

After completion of the attaching of the cup C to the lens LE, the processing of the lens LE is executed by the processing apparatus 20. The cup C attached to the lens LE is attached to a cup receiver on the rotation shaft 32*a* side. By pressing a switch 23*k*, the rotation shaft 32*b* is moved so as to chuck the lens LE. When a switch 23*m* is pushed, the configuration of the lens LE is measured by the lens-configuration measuring section 21. Bevel calculation is performed on the basis of the thus measured data. The screen on the display 22 is switched to a bevel simulation screen to display the configuration of a bevel section. When the switch

23*m* is pushed again after confirmation of the bevel section configuration, the control unit 40 performs rough processing and finishing processing with the respective whetstones successively by turning the carriage 33 while rotating the rotation shafts 32*a* and 32*b* on the basis of the processing data (the processing operation can be known by referring to JP-A-5-212661 (U.S. Pat. No. 5,347,762), or the like).

Figure 6:
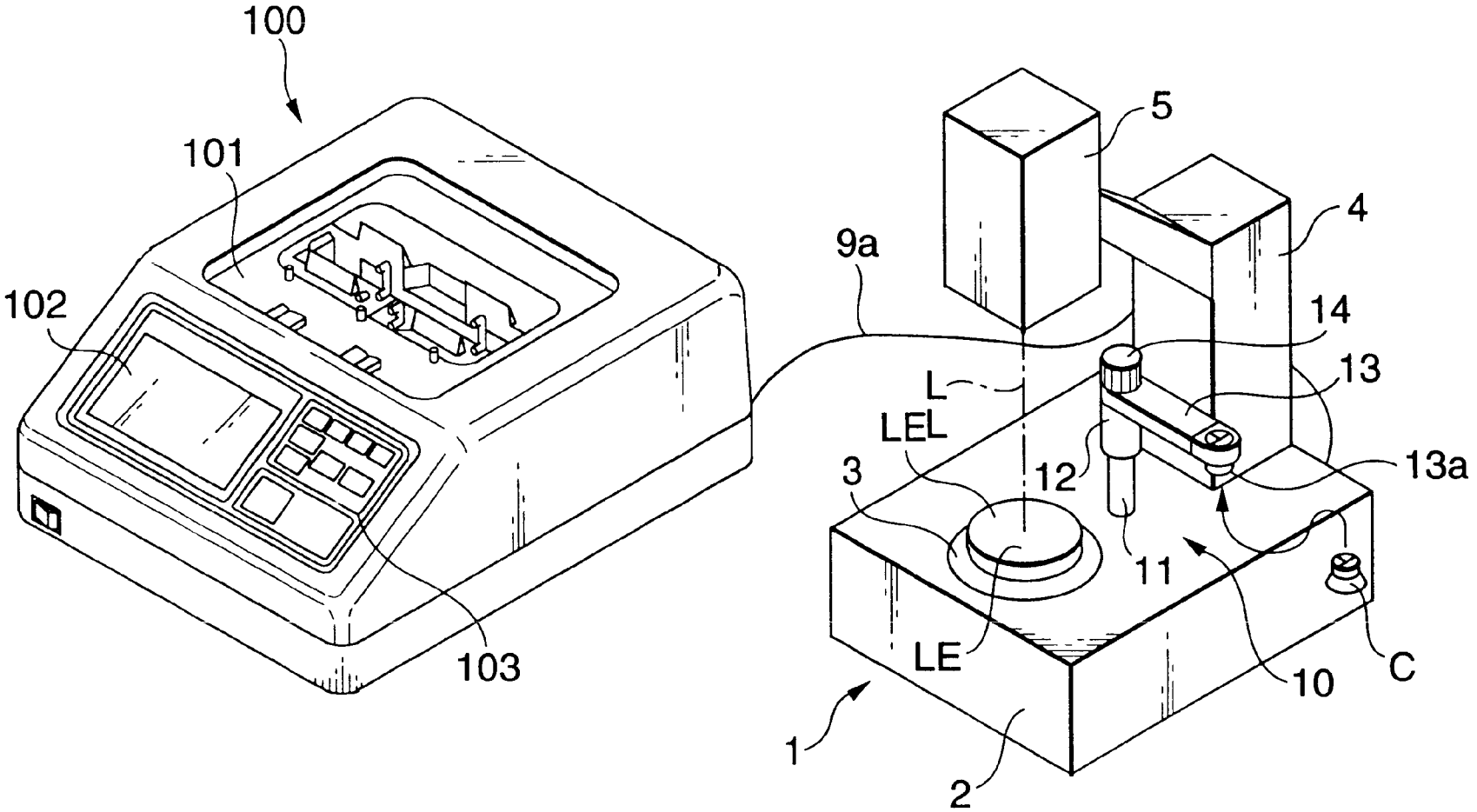
FIG. 6 is a view showing a system configuration in which the eyeglass frame-configuration measuring apparatus and the axial alignment apparatus are connected to each other.

The above description has been made about a system configuration in which the display 22 provided in the processing apparatus 20 is used for observation of an image picked up by the CCD camera 9 provided in the axial alignment apparatus 1. However, the present invention can be applied also to a system configuration connected to an eyeglass frame configuration measuring apparatus 100 for measuring the configuration of an eyeglass frame and performing the layout thereof, as shown in FIG. 6. It is convenient to use this eyeglass frame configuration measuring apparatus 100 in case that the processing work and the eyeglass frame measuring work are performed separately in the concentrated processing of eyeglass lenses.

In FIG. 6, the eyeglass frame configuration measuring apparatus 100 is structured by an eyeglass frame measuring section 101, a display 102 disposed in the front surface of a box of the apparatus 100, and an operation panel 103. Like the previous example, the configuration of an eyeglass frame to which the lens LE is set is measured by the measuring section 101. An input image of the layout and an intended lens configuration based on the measured frame data are indicated on the display 102. Accordingly, switches on the operation panel 103 are operated so as to input layout data. Further, a picture signal from the CCD camera 9 of the axial alignment apparatus 1 is inputted into the apparatus 100 so that an image picked up by the CCD camera 9 is indicated on the display 102. Like the above description, by comparing the lens image with the intended lens configuration after performing the axial alignment of the lens LE while observing the indication on the display 102, the operator can judge whether the processing can be applied to the lens or not. Incidentally, the frame data obtained by the apparatus 100 after the completion of the layout is transferred to a processing apparatus (not shown).

In such a system configuration, the axial alignment work can be provided also separately to attain the improvement of overall workability. Because the display 102 is used for observation of the axial alignment apparatus 1, the overall configuration is simplified so that both space saving and cost reduction can be attained.

As described above, according to the present invention, the configuration of the axial alignment apparatus is simplified so that a judgment can be made easily as to whether processing can be applied to the lens or not. Further, both space saving and cost reduction can be attained on the whole of the system configuration of the processing apparatus or the eyeglass frame configuration measuring apparatus.

The entire disclosure of each and every foreign patent application from which the benefit of foreign priority has been claimed in the present application is incorporated herein by reference, as if fully set forth.

While only certain embodiments of the invention have been specifically described herein, it will apparent that numerous modification may be made thereto without departing from the spirit and scope of the invention.

What is claimed is:

1. An eyeglass lens processing system comprising an eyeglass lens processing apparatus for processing an eyeglass lens to be fitted to an intended lens configuration, and an axial alignment apparatus for attaching a cup as a processing jig to the lens, the eyeglass lens processing apparatus including:

a processing device for processing the lens;

an input device for inputting data of the intended lens configuration;

a display; and a display controlling portion of controlling the display, the axial alignment apparatus including:

a locating device for locating the lens at a predetermined position;

an imaging device for picking up an image of the located lens;

a transmission device for transmitting the picked-up image of the lens to the display controlling portion; and an attaching device for attaching the cup to the lens, wherein the display controlling portion has a formation device for graphic-forming the intended lens configuration on the basis of the inputted data of the intended lens configuration, and for graphic-forming an axial-alignment mark on a position having a predetermined positional relation with respect to a position corresponding to a pick-up optical axis on the display.

2. The eyeglass lens processing system according to claim 1, wherein the eyeglass lens processing apparatus further includes a layout device for inputting layout data for performing layout of the lens with regard to the intended lens configuration, wherein the formation device forms the axial-alignment mark and the intended lens configuration on the display on the basis of the layout data inputted by the layout device.

3. The eyeglass lens processing system according to claim 1, wherein the eyeglass lens processing apparatus further includes a measurement device for measuring the intended lens configuration, wherein the input device inputs the data of the intended lens configuration measured by the measurement device.

4. An eyeglass lens processing preparation system comprising an intended lens configuration measuring apparatus for measuring an intended lens configuration, and an axial alignment apparatus for attaching a cup as a processing jig to a lens, the measuring apparatus including:

a measurement device for measuring the intended lens configuration;

a display; and a display controlling portion for controlling the display, the axial alignment apparatus including:

a locating device for locating the lens at a predetermined position;

an imaging device for picking up an image of the located lens;

a transmission device for transmitting the picked-up image of the lens to the display controlling portion; and an attaching device for attaching the cup to the lens, wherein the display controlling portion has a formation device for graphic-forming the measured intended lens configuration, and for graphic-forming an axial-alignment mark on a position having a predetermined positional relation with respect to a position corresponding to a pick-up optical axis on the display.

5. The eyeglass lens processing preparation system according to claim 4, wherein the measuring apparatus further includes a layout device for inputting layout data for performing layout of the intended lens configuration, wherein the formation device forms the axial-alignment mark and the intended lens configuration on the display on the basis of the layout data inputted by the layout device.

6. The eyeglass lens processing preparation system according to claim 5, further comprising an input device for supplying the data of the intended lens configuration after the layout performed by the layout device of an eyeglass lens processing apparatus.

7. The eyeglass lens processing preparation system according to claim 4, further comprising an input device for supplying the data of the intended lens configuration measured by the measurement device to an eyeglass lens processing apparatus.

* * * * *

UNITED STATES PATENT AND TRADEMARK OFFICE

CERTIFICATE OF CORRECTION

PATENT NO. : 6,427,094 B1
DATED : July 30, 2002
INVENTOR(S) : Toshiaki Mizuno

It is certified that error appears in the above-identified patent and that said Letters Patent is hereby corrected as shown below:

Column 9,
Line 2, after "of" insert -- the lens with regard to --

Signed and Sealed this

Sixteenth Day of March, 2004

JON W. DUDAS
*Acting Director of the United States Patent and Trademark Office*